United States Patent [19]

Romine et al.

[11] 4,415,080

[45] Nov. 15, 1983

[54] SLITTER BLADE CARRYING CASE

[75] Inventors: Donnie Romine, Rogersville; Harry L. Woodard, Moulton, both of Ala.

[73] Assignee: Champion International Corporation, Stamford, Conn.

[21] Appl. No.: 341,845

[22] Filed: Jan. 22, 1982

[51] Int. Cl.[3] ..... B65D 85/02; B65D 85/62; B65D 25/28

[52] U.S. Cl. ..... 206/303; 206/349; 206/372; 211/40

[58] Field of Search ..... 206/303, 45.34, 356, 206/444, 516, 349, 372; 211/40

[56] References Cited

U.S. PATENT DOCUMENTS

| | | | |
|---|---|---|---|
| 2,030,465 | 2/1936 | Nist | 206/303 |
| 3,053,424 | 9/1962 | Reinhard | 206/303 |
| 3,084,788 | 4/1963 | Ford | 206/45.34 |
| 3,429,653 | 2/1969 | Brett | 206/356 |
| 3,913,735 | 10/1975 | Durbin | 206/303 |

*Primary Examiner*—William T. Dixson, Jr.

*Attorney, Agent, or Firm*—Evelyn M. Sommer; William W. Jones

[57] ABSTRACT

A case for carrying and storing a web slitting blade includes a rubber padded circular platform having a central post extending upwardly therefrom for receiving the hub of a web slitter blade. A cylindrical cover is threadedly connected to the central post to enclose the slitter blade and complete the carrying case. The threaded member connecting the cover to the post includes a key-shaped opening to provide a handle for ease of carrying of the case.

1 Claim, 3 Drawing Figures

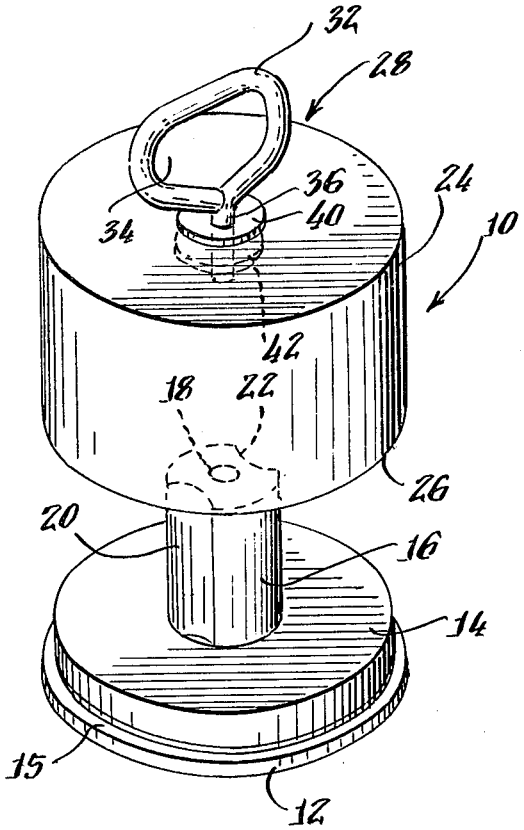
Fig. 1.
Fig. 2.
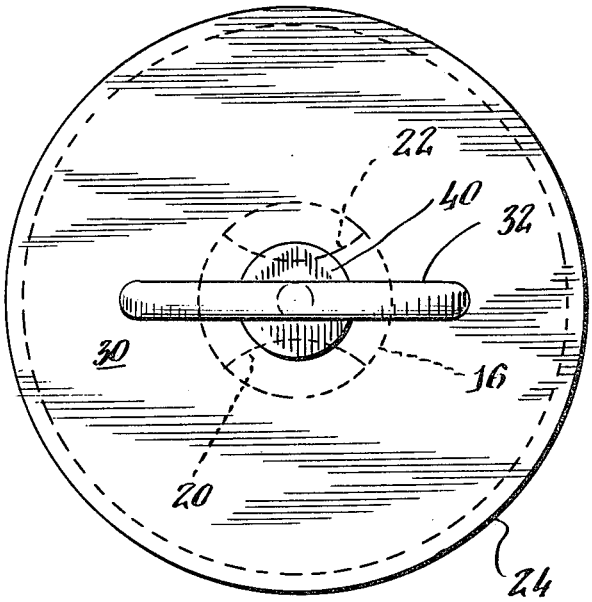
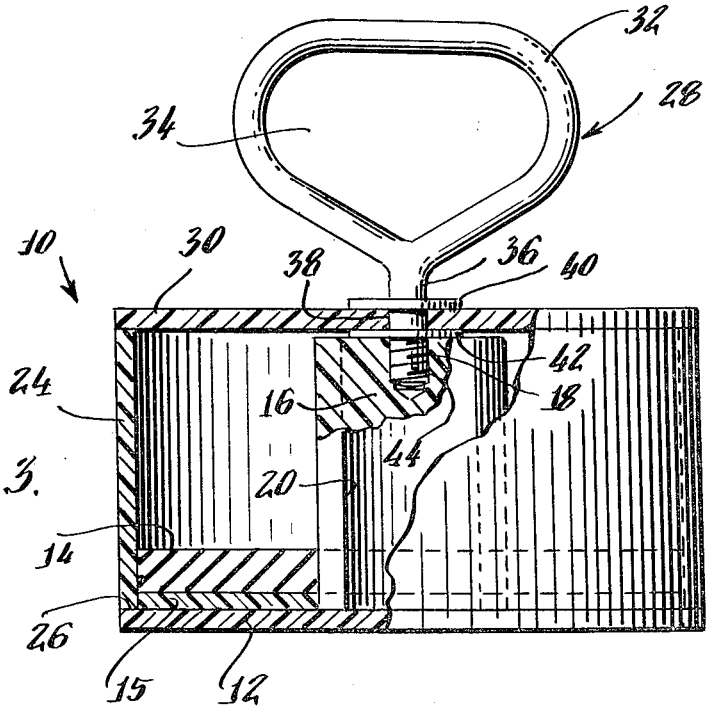
Fig. 3.

SLITTER BLADE CARRYING CASE

BACKGROUND AND SUMMARY OF THE INVENTION

This invention relates to a portable carrying case, and more particularly, a portable carrying case designed for the transporting and storage of slitter wheel blades used to cut paper webs and the like.

Heretofore, a box, without a lid, was used to transport and carry slitter wheels about a paper mill. The box had a strap on it connected to opposite portions of the box to facilitate handling. The slitter wheels carried in such an open box were dangerous in that the person carrying the box could be cut and the wheels damaged since they were freely movable in the box thereby enabling them to abrade against each other. The slitter carrying case of the present invention overcomes these objectionable features in the handling of such web slitter wheels.

In accordance with the present invention a case for carrying and storing a web slitting blade includes a rubber padded circular platform having a central post extending upwardly therefrom for receiving a web slitter blade. A cylindrical cover is threadedly connected to the central post to enclose the slitter blade and complete the carrying case. The threaded member connecting the cover to the post includes a key shaped-opening to provide a handle for ease of carrying of the case.

BRIEF DESCRIPTION OF THE DRAWING

Further objects and advantages of the invention will become apparent from the following description and claims, and from the accompanying drawing, wherein:

FIG. 1 is an exploded perspective view of the slitter blade carrying case of the present invention;

FIG. 2 is a top plan view of the carrying case of FIG. 1; and

FIG. 3 is a side view in elevation of the carrying case of FIG. 1, with portions broken away and shown in section, for purposes of illustration.

DETAILED DESCRIPTION OF PREFERRED EMBODIMENT

Referring now to the drawing in detail, wherein like numerals indicate like elements throughout the several views, the slitter blade carrying case 10 of the present invention includes a circular base 12 having a circular rubber pad 14 adhesively secured to a raised platform portion 15 integral with base 12. The pad 14 and platform 15 are of a slightly less diameter than the base 12.

Extending upwardly from the center of the base 12 through platform 15 and pad 14 is an elongated post 16 having a threaded opening 18 at its upper end thereof. Post 16 is generally cylindrical in shape except for a pair of oppositely facing grooves 20 and 22 providing the post 16 with a shape which is complementary to the hub of a paper web slitter blade. A slitter blade can be disposed on rubber pad 14 and supported by base 12 and platform 15 by telescoping the hub of the blade over post 16 aligning grooves 20 and 22 with the hub of the blade.

The case 10 is provided with a substantially cylindrical cover or hood 24 which is disposed over the slitter blade disposed on pad 14 on platform 15. The cylindrical hood or cover 24 has a lower edge or rim 26 which seats on base 12 below pad 14 and platform 15 to completely enclose the platform and pad. The cover or hood 24 has a handle construction generally designated by the numeral 28 extending upwardly from a closed upper surface 30 thereof.

Handle construction 28 includes a key-shaped handle element 32 having a central opening 34 therethrough connected to an elongated shank 36 extending through a central opening 38 in top surface 30 of cover element 24. Welded to shank 36 are a pair of spaced washers 40 and 42 on either side of top surface 30. Washers 40 and 42 preclude the key-shaped handle 28 from being removed from the cover or hood 24, but enable he same to fully rotate thereon. The lower end of shank 36 is threaded as shown at 44 and can be rotatively received within threaded opening 18 in the top of post 16 to secure the cover to the posts and base 12, enabling a slitter blade wheel supported on base 12 to be transported.

Because of the hood or cover 24 completely covering the blade, there is little probability of an accident wherein a person transporting the blade could be cut by the blade. The slitter blade could also be stored in the cutter carrying case 10. When the blade is moved to a use location, the hood or cover 24 can be unthreaded from post 16 by rotating shank 36 in opening 18 by simply grasping the key-shaped upper portion 32 of the handle 28 and rotating the same.

What is claimed as new is:

1. A carrying case for slitter blades, said case comprising:

(a) a circular base;

(b) an upright post secured to said base and extending upwardly from the center thereof, said post including a threaded opening in a top surface thereof, and said post including a pair of diametrically opposed elongated grooves thereon complimentary to a slitter blade hub;

(c) a cylindrical hood adapted to overlie said base and post, said hood having a cylindrical side wall and a top wall closing one end of said cylindrical side wall; and (d) a centrally located handle element rotatably mounted on said top wall of said hood, said handle element including a threaded shank portion extending through an opening in said hood top wall for threaded engagement with said threaded opening in said upright post, said handle element further comprising a pair of washers secured thereto on each side of said hood top wall of connect said handle element to said hood while permitting rotation of said handle element with respect to said hood.

* * * * *